US008286643B2

(12) United States Patent
Li et al.

(10) Patent No.: US 8,286,643 B2
(45) Date of Patent: Oct. 16, 2012

(54) NAIL CARE DEVICE

(75) Inventors: Yun-Li Li, Tainan County (TW); Ching-Ching Chiu, Tainan County (TW)

(73) Assignee: Genesis Photonics Inc., Shanhua, Tainan (TW)

( * ) Notice: Subject to any disclaimer, the term of this patent is extended or adjusted under 35 U.S.C. 154(b) by 27 days.

(21) Appl. No.: 12/964,687

(22) Filed: Dec. 9, 2010

(65) Prior Publication Data

US 2011/0139167 A1 Jun. 16, 2011

(30) Foreign Application Priority Data

Dec. 11, 2009 (TW) ..... 98142506 A

(51) Int. Cl.
*A45D 29/00* (2006.01)
*A61N 5/06* (2006.01)

(52) U.S. Cl. ..... 132/73; 607/88; 362/103; 362/189

(58) Field of Classification Search ..... 132/73, 132/285; 2/21; 362/103, 189; 63/42; D28/56, D28/58, 62; 600/322, 323, 340, 344; 606/2, 606/9–11; 607/88, 91
See application file for complete search history.

(56) References Cited

U.S. PATENT DOCUMENTS 4,731,541 A * 3/1988 Shoemaker ..... 250/504 R
4,988,883 A * 1/1991 Oppawsky ..... 250/492.1
5,130,551 A * 7/1992 Nafziger et al. ..... 250/492.1
5,515,621 A * 5/1996 Bloom ..... 34/275
5,699,816 A * 12/1997 Banes et al. ..... 132/285
5,954,245 A * 9/1999 Kluesner ..... 223/101
6,595,918 B2 * 7/2003 Gopinathan et al. ..... 600/300
6,762,425 B1 * 7/2004 Strait ..... 250/504 R
7,118,589 B2 * 10/2006 Vlahos ..... 607/94
7,712,473 B1 * 5/2010 Robinson et al. ..... 132/73
2002/0198443 A1 * 12/2002 Ting ..... 600/323
2003/0235048 A1 * 12/2003 Gyori ..... 362/103
2004/0223321 A1 * 11/2004 Crowley ..... 362/103
2005/0070775 A1 * 3/2005 Chin et al. ..... 600/323
2006/0109645 A1 * 5/2006 Ferrari et al. ..... 362/103
2007/0073126 A1 * 3/2007 Raridan ..... 600/323
2007/0123756 A1 * 5/2007 Kitajima et al. ..... 600/300
2007/0244376 A1 * 10/2007 Wang ..... 600/310
2007/0244377 A1 * 10/2007 Cozad et al. ..... 600/323
2008/0119700 A1 * 5/2008 DeGould ..... 600/323
2008/0142024 A1 * 6/2008 Rastegar et al. ..... 128/893
2008/0281174 A1 * 11/2008 Dietiker ..... 600/336
2009/0219709 A1 * 9/2009 Chen ..... 362/103
2010/0238650 A1 * 9/2010 Haney ..... 362/103
2010/0256551 A1 * 10/2010 Maltezos et al. ..... 604/20
2010/0317936 A1 * 12/2010 Al-Ali et al. ..... 600/323
2011/0310593 A1 * 12/2011 Lee et al. ..... 362/103

* cited by examiner

*Primary Examiner* — Todd Manahan
*Assistant Examiner* — Tatiana Nobrega
(74) *Attorney, Agent, or Firm* — The Mueller Law Office, PC

(57) ABSTRACT

A nail care device includes a covering part, a light-emitting component, and a light-emitting control module. The covering part is configured for covering a tip of a digit of a limb. The light-emitting component is disposed in the covering part in a manner that light emitted by the light-emitting component irradiates a nail on the tip of the digit covered by the covering part. The light-emitting control module is coupled to the light-emitting component and is operable to control operation of the light-emitting component.

20 Claims, 11 Drawing Sheets

NAIL CARE DEVICE

CROSS-REFERENCE TO RELATED APPLICATION

This application claims priority of Taiwanese application No. 098142506, filed on Dec. 11, 2009.

BACKGROUND OF THE INVENTION

1. Field of the Invention

The invention relates to a nail care device, more particular to a nail care device capable of irradiating a nail on a tip of a digit of a limb.

2. Description of the Related Art

Referring to FIG. 1, a conventional nail care device 900 is shown for irradiating fingernails on a hand with UV light after a manicure treatment.

However, since the fingers of the user's hand must be disposed in the nail care device 900 during irradiation with the UV light, the user cannot do anything with his/her hand while waiting for nail polish to dry. Further, UV light emitted by a light-emitting component in the nail care device 900 is not directed toward individual fingernails, which results in a relatively low light utilization efficiency.

SUMMARY OF THE INVENTION

Therefore, the object of the present invention is to provide a nail care device capable of alleviating the above drawbacks of the prior art.

According to the present invention, there is provided a nail care device comprising a covering part, a light-emitting component, and a light-emitting control module. The covering part is configured for covering a tip of a digit of a limb. The light-emitting component is disposed in the covering part in a manner that light emitted by the light-emitting component irradiates a nail on the tip of the digit covered by the covering part. The light-emitting control module is coupled to the light-emitting component and is operable to control operation of the light-emitting component.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
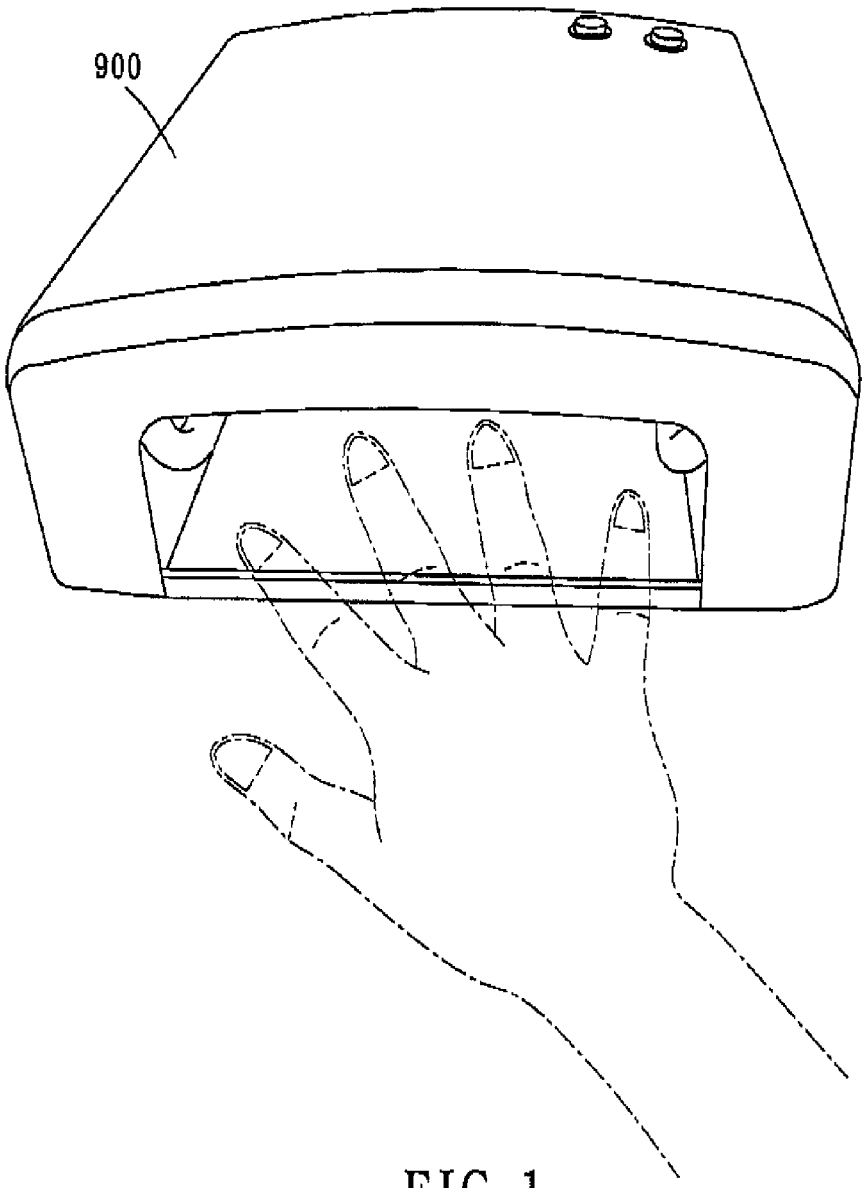
FIG. 1 PRIOR ART
FIG. 1 is a schematic perspective view of a conventional nail care device.

Before the present invention is described in greater detail, it should be noted that like reference numerals are used to indicate corresponding or analogous elements throughout the accompanying disclosure.

Figure 2:
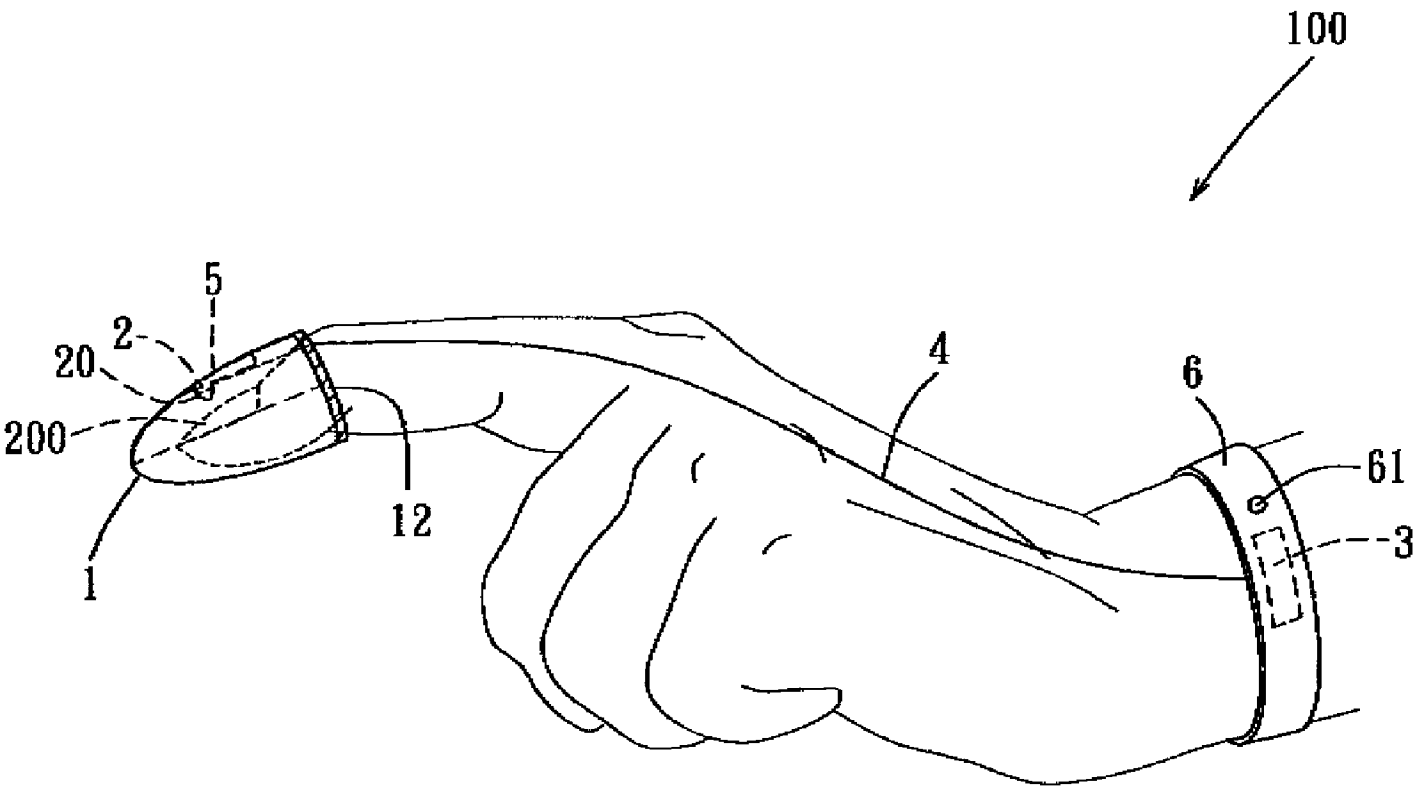
FIG. 2 is a schematic perspective view of a first preferred embodiment of a nail care device, illustrating a covering part covering a tip of a finger of a hand.
Figure 3:
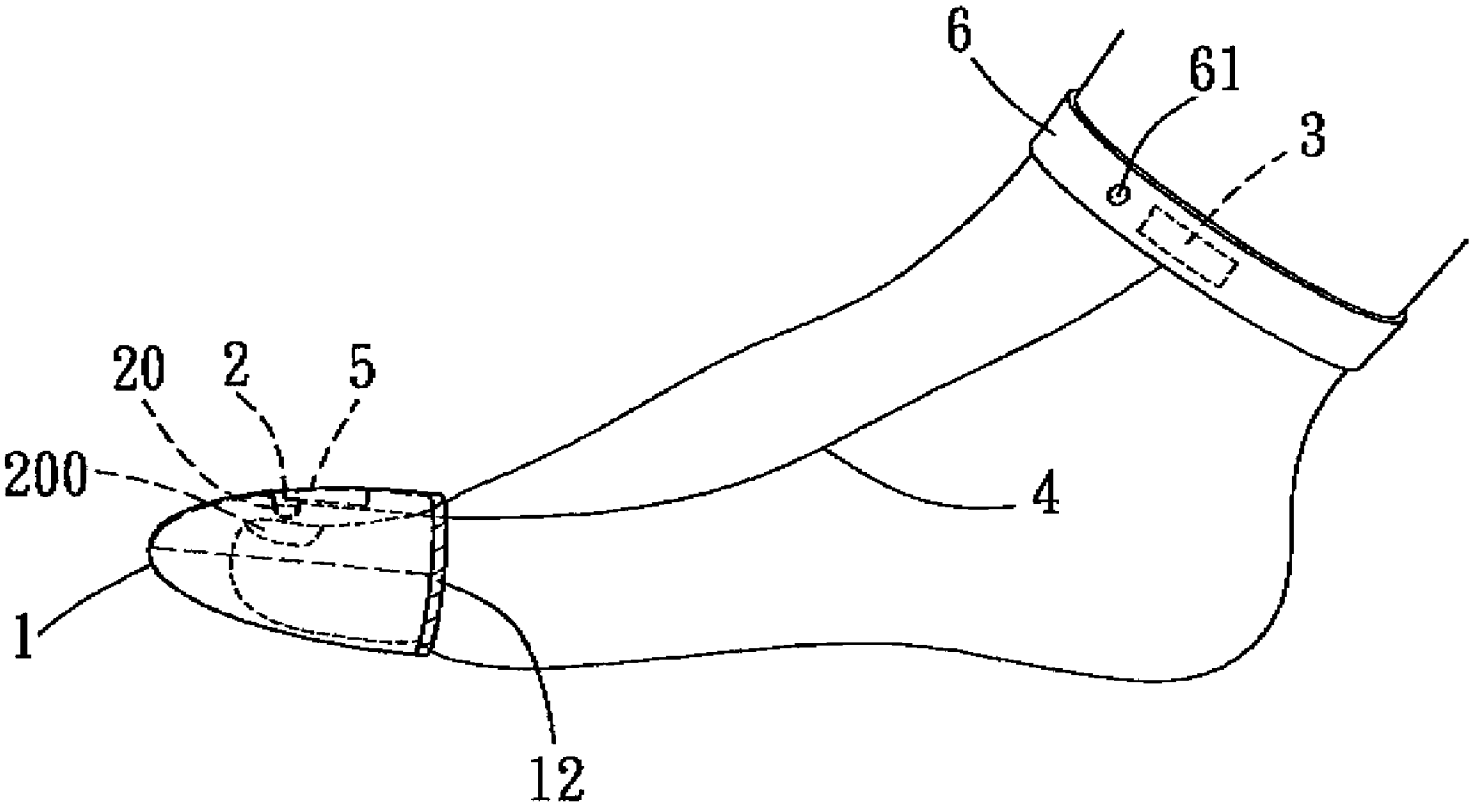
FIG. 3 is a schematic perspective view of the first preferred embodiment, illustrating the covering part covering a tip of a toe of a foot.
Figure 4:
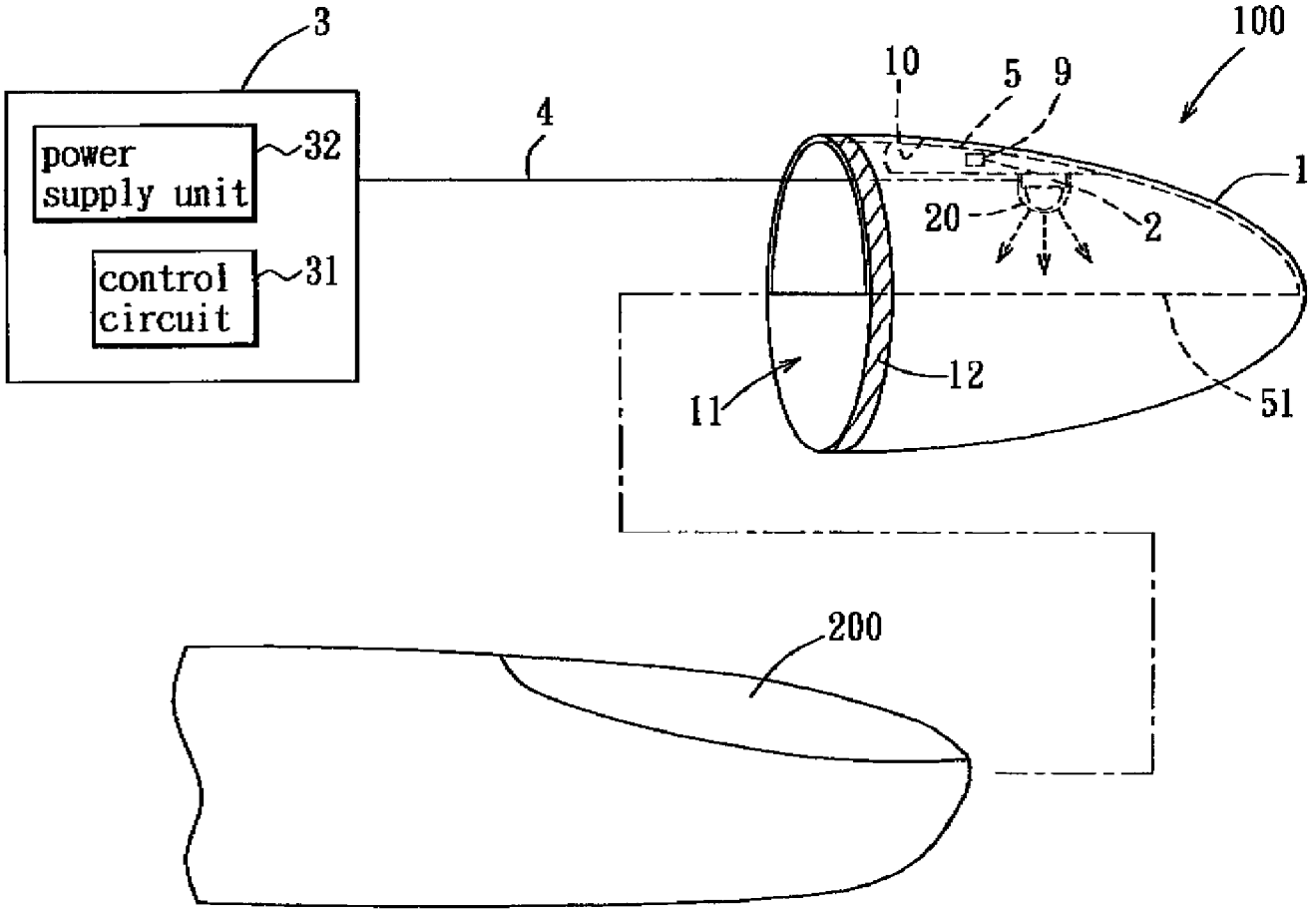
FIG. 4 is a schematic perspective view and a block diagram of the first preferred embodiment, illustrating a control unit of the nail care device coupled to the covering part.

Referring to FIGS. 2 to 4, a first preferred embodiment of a nail care device 100 according to the present invention is shown. The nail care device 100 comprises a covering part 1, a light-emitting component 2, a control unit 3, a transmission wire 4, and a light-emitting control module 9.

The covering part 1 is adapted to be sleeved on a tip of a digit of a limb, such as a fingertip of a hand or a toe of a foot, and is made of a flexible material in this embodiment. The covering part 1 defines an opening 11 for insertion of the tip of the digit of the limb into the covering part 1, has a wall portion 10 configured to be spaced apart from and to face a nail 200 on the tip of the digit covered by the covering part 1, and is provided with a fixing unit 12 for holding removably the covering part 1 to the tip of the digit covered by the covering part 1. In this embodiment, the fixing unit 12 is configured as an elastic band provided on the covering part 1 adjacent to the opening 11 for binding removably the covering part 1 to the tip of the digit covered by the covering part 1.

The light-emitting component 2 is disposed on the wall portion 10 in the covering part 1 in a manner that light emitted by the light-emitting component 2 irradiates the nail 200 on the tip of the digit covered by the covering part 1. Preferably, the light-emitting component is a UV light-emitting diode capable of emitting light within a wavelength range of from 280 nm-460 nm but not limited to such.

The light-emitting control module 9 is disposed on the covering part 1, is coupled to the light-emitting component 2, and is operable to control operation of the light-emitting component 2. In this embodiment, the light-emitting control module 9 is a control chip that has an area of approximately 0.2 to 10 $mm^2$ and is configured to control operation of the light-emitting component 2 such that the light emitted by the light-emitting component 2 falls within a specified frequency range of a full frequency spectrum of the light-emitting component 2. It should be noted that a plurality of the light-emitting control modules 9 may be disposed on the covering part 1 to control operation of the light-emitting component 2, such that the light emitted by the light-emitting component 2 falls within a selected one of a plurality of specified frequency ranges of a full frequency spectrum of the light-emitting component 2. The number and the type of the light-emitting component 2 can vary depending on requirements, e.g., the light-emitting component 2 can be an organic light-emitting diode (OLED) for medical use.

The control unit 3 includes a control circuit 31 for generating a control signal to control operation of the light-emitting control module 9, and a power supply unit 32 for providing electric power to the control unit 3, the light-emitting control module 9 and the light-emitting component 2. In this embodiment, the power supply unit 32 is a detachable rechargeable battery but is not limited to such.

The transmission wire 4 is coupled between the light-emitting control module 9 and the control circuit 31 for transmitting the control signal from the control circuit 31 to the light-emitting control module 9.

The nail care device 100 further comprises a wearable accessory 6 configured as a wrist accessory (such as a wrist band) for mounting the control unit 3 thereon. It should be noted that the wearable accessory 6 may be a neck accessory or a leg accessory in other embodiments of this invention.

The nail care device 100 further comprises an optical control unit 20 disposed in the covering part 1 and surrounding the light-emitting component 2 for directing the light emitted by the light-emitting component 2 toward the nail 200 on the tip of the digit covered by the covering part 1. The optical control unit 20 is one of an optical lens, a light guide and a reflector, and is made of silicon, glass, organic polymer or inorganic polymer. Therefore, light emitted by the light-emitting component 20 can be uniformed and directed toward the nail 200 on the tip of the digit, which results in a relatively high light utilization efficiency. It should be noted that the optical control unit 20 may be manufactured by MEMS or molding processes.

The nail care device 100 further comprises a curved spacer 5 that is disposed in the covering part 1, that has the light-emitting control module 9 and the light-emitting component 2 mounted thereon, and that has two side edges 51 for abutting against opposite lateral sides of the tip of the digit covered by the covering part 1 so as to space apart the light-emitting component 2 from the nail 200 on the tip of the digit covered by the covering part 1.

It should be noted that, the covering part 1 can be made of a material that has a rigidity sufficient for spacing apart the light-emitting component 2 from the nail 200. Hence, the curved spacer 5 may be omitted in other embodiments of this invention.

Figure 5:
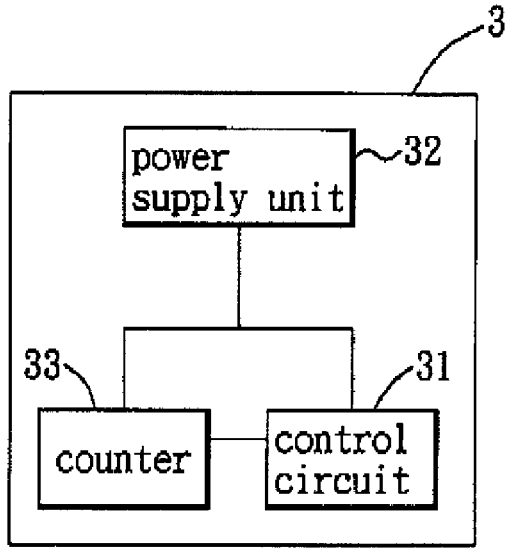
FIG. 5 is a block diagram of the first preferred embodiment, illustrating components of the control unit.
Figure 6:
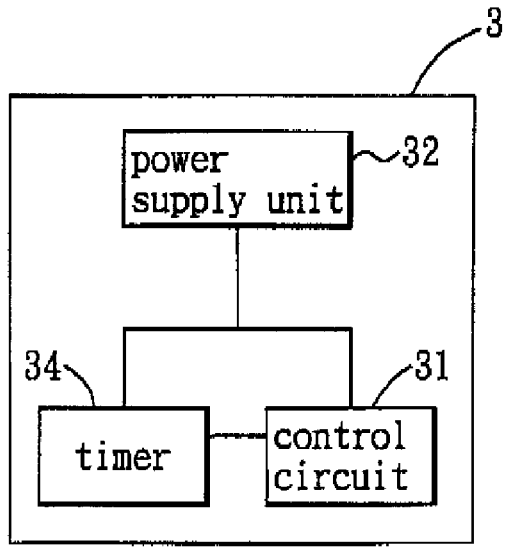
FIG. 6 is a block diagram of the first preferred embodiment, illustrating a modified control unit.

Referring to FIGS. 5 and 6, the control unit 3 further includes a controller configured as a counter 33 or a timer 34. The wearable accessory 6 has a switch 61 that is operated for generating a trigger signal and that is electrically connected to the controller and the control circuit 31 for transmitting the trigger signal thereto.

In the case of the counter 33 (see FIG. 5), when the trigger signal generated by the switch 61 is transmitted to the counter 33 and the control circuit 31, the counter 33 starts to count and the control circuit 31 generates the control signal that is received by the light-emitting control module 9 for controlling operation of the light-emitting component 2, such that the light-emitting component 2 is turned on and the light emitted by the light-emitting component 2 irradiates the nail 200. The control circuit 31 is also coupled to the counter 33 for detecting the value counted by the counter 33. When the counter 33 has counted to a predetermined value, the control circuit 31 generates another control signal to control the light-emitting control module 9 to turn off the light-emitting component 2.

In the case of the timer 34 (see FIG. 6), when the trigger signal generated by the switch 61 is transmitted to the timer 34 and the control circuit 31, the timer 34 starts to count the time and the control circuit 31 generates the control signal that is received by the light-emitting control module 9 for controlling operation of the light-emitting component 2, such that the light-emitting component 2 is turned on and the light emitted by the light-emitting component 2 irradiates the nail 200. The control circuit 31 is also coupled to the timer 34 for detecting the time counted by the timer 34. When the timer 34 has counted to a predetermined time, the control circuit 31 generates another control signal to control the light-emitting control module 9 to turn off the light-emitting component 2.

Therefore, after the switch 61 is operated by the user, the light-emitting component 2 is turned on to irradiate the nail 200 and is turned off automatically after a predetermined time (e.g., 3 minutes), i.e., the controller is for controlling duration of activation of the light-emitting component 2 to thereby avoid excessive irradiation of the nail 200.

Figure 7:
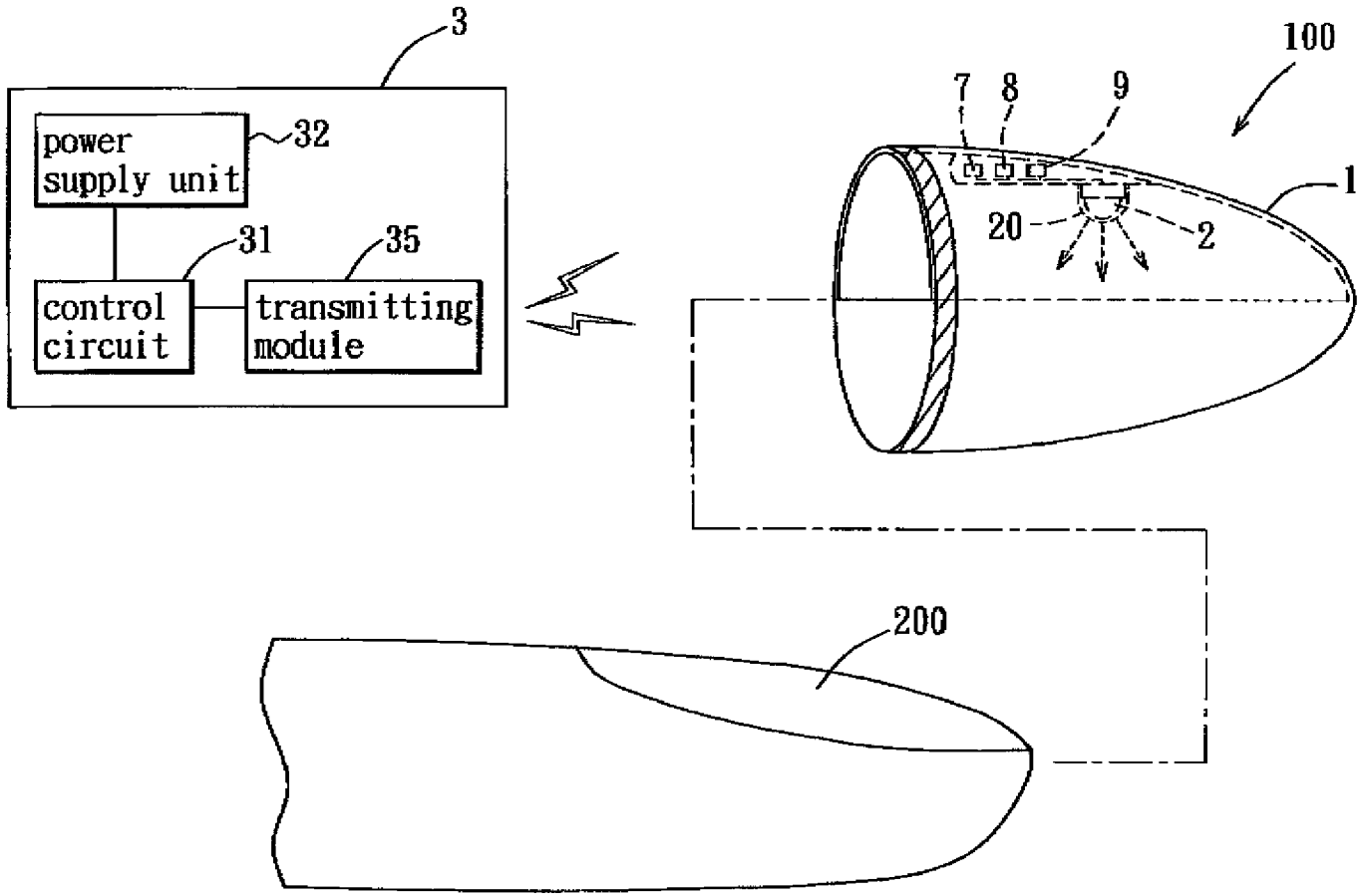
FIG. 7 is a schematic perspective view of a second preferred embodiment of the nail care device according to the present invention.

Referring to FIG. 7, a second preferred embodiment of the nail care device 100 according to the present invention has a structure similar to that of the first embodiment. The main difference between this embodiment and the first embodiment resides in the following. In this embodiment, the transmission wire 4 as illustrated in the first preferred embodiment is omitted. The control unit 3 further includes a transmitting module 35 for wireless transmission of the control signal, and a power supply unit 32 for providing electric power to the control unit 3. The wireless transmission may be one of infrared, Bluetooth, and radio frequency transmission.

The nail care device 100 further comprises a receiving module 7 and a power supply 8. The receiving module 7 is disposed on the covering part 1 for wireless reception of the control signal transmitted by the control unit 31, and is coupled to the light-emitting control module 9 for providing the control signal received thereby to the light-emitting control module 9. The power supply 8 is also provided on the covering part 1 for providing electric power to the receiving module 7, the light-emitting control module 9, and the light-emitting component 2.

After the control signal is received by the receiving module 7 and is transmitted to the light-emitting control module 9, the light emitted by the light-emitting component 2 irradiates the nail 200 on the tip of a digit as controlled by the light-emitting control module 9. The second preferred embodiment has the same advantages as those of the first preferred embodiment.

Figure 8:
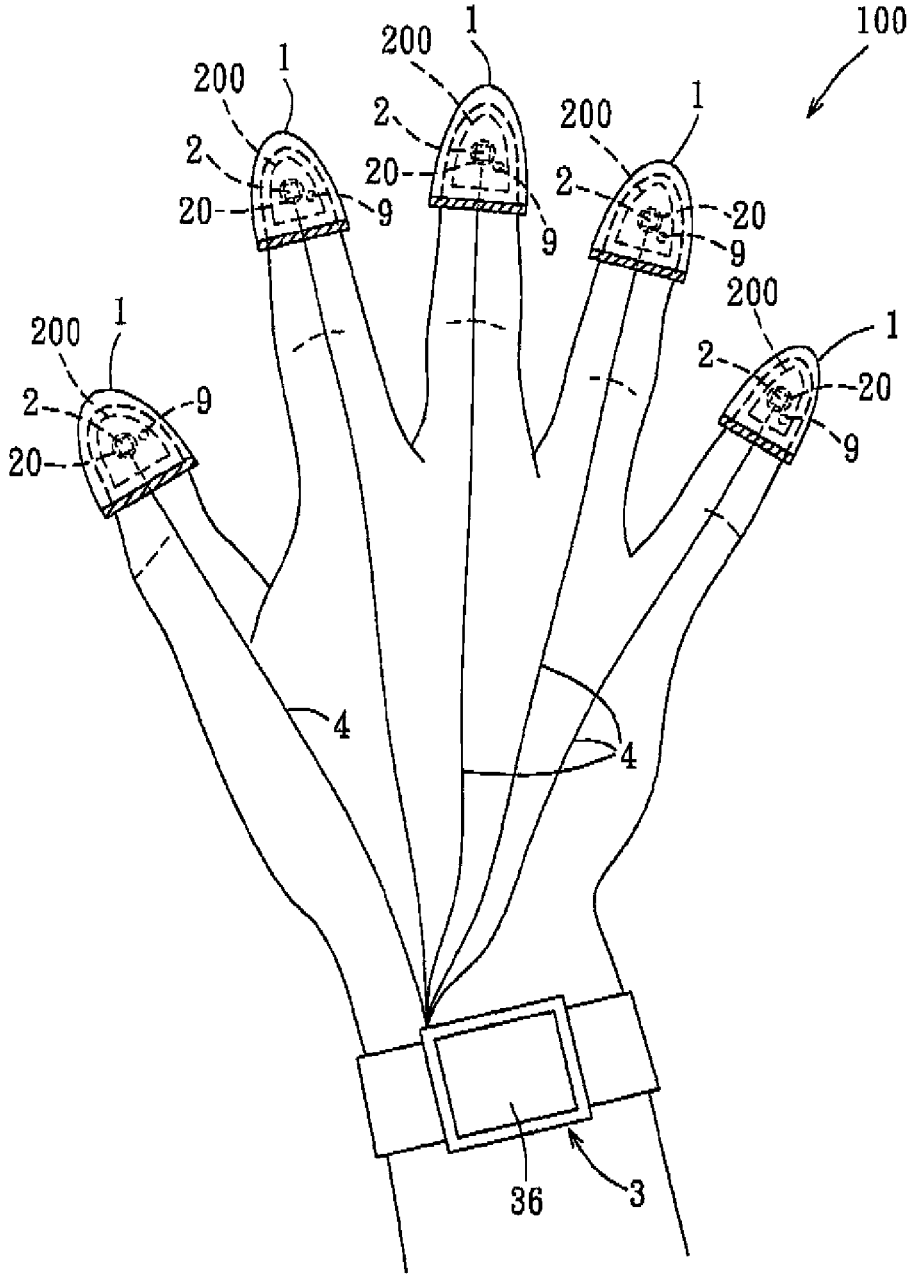
FIG. 8 is a schematic top view of a third preferred embodiment of the nail care device according to the present invention.
Figure 9:
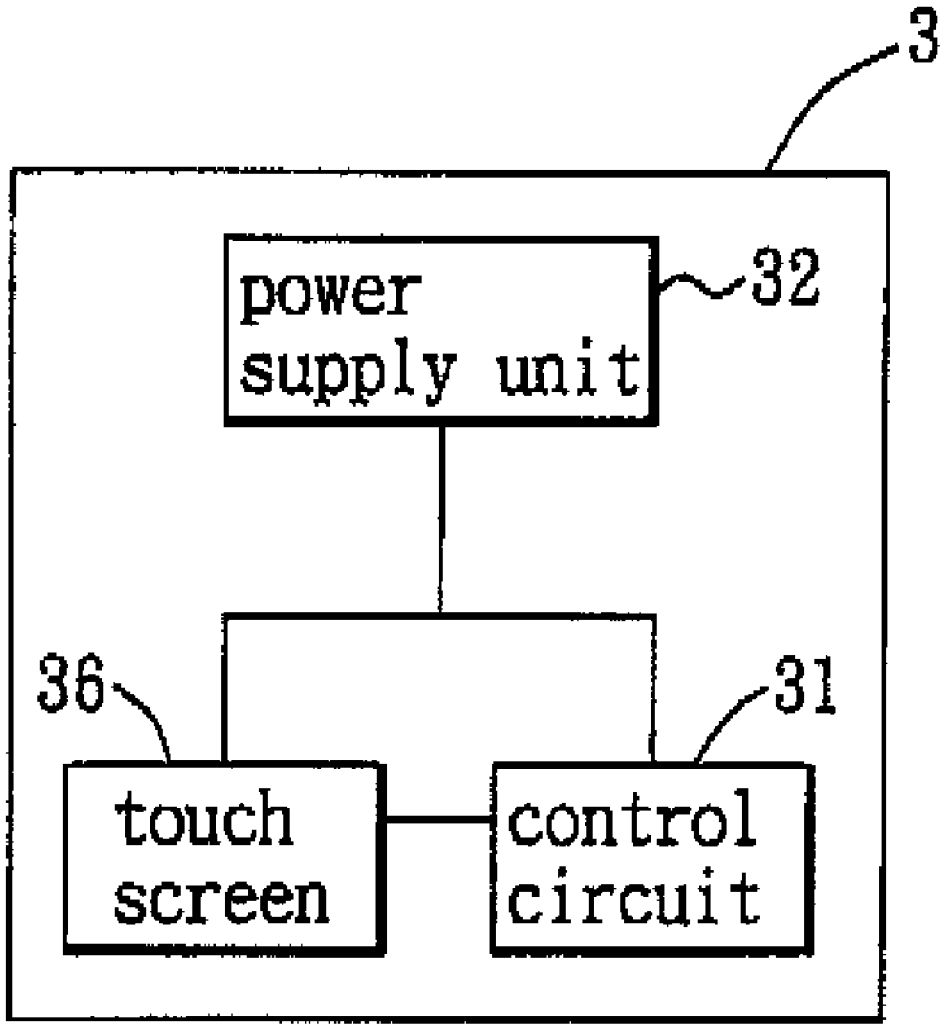
FIG. 9 is a block diagram of the third preferred embodiment, illustrating components of the control unit of the nail care device.

Referring to FIGS. 8 and 9, a third preferred embodiment of the nail care device 100 according to the present invention has a structure similar to that of the first embodiment. The main difference between this embodiment and the first embodiment resides in the following. In this embodiment, the nail care device 100 comprises five covering parts 1, five light-emitting components 2, five optical control units 20, five light-emitting control modules 9, and five transmission wires 4. The control unit 3 includes a control circuit for controlling individual operations of the light-emitting control modules 9. Each of the transmission wires 4 is coupled between a respective one of the light-emitting control modules 9 and the control circuit 31 of the control unit 3 for transmitting the control signal from the control circuit 31 to the light-emitting control module 9. Each of the covering parts 1 is adapted to be sleeved on the tip of a respective digit of the limb. Each of the light-emitting components 2 is disposed in a respective one of the covering parts 1, and is spaced apart from and faces the nail 200 on the tip of the corresponding digit of the limb. Each of the light-emitting control modules 9 is coupled to and controls operation of a respective one of the light-emitting components 2 according to control from the control circuit 31 so as to irradiate the nail 200 on the tip of the corresponding digit covered by the corresponding covering part 1. Each of the optical control units 20 is disposed in a respective one of the covering parts 1 and surrounds the corresponding one of the light-emitting components 2 for directing the light emitted by the light-emitting component 2 toward the nail 200 on the tip of the corresponding digit covered by the respective covering part 1.

The control unit 3 further includes a touch screen 36 coupled to the control circuit 31 and displaying a graphical user interface thereon, and the power supply 32 for providing electric power to the touch screen 36. The graphical user interface has a plurality of options for selection by a user, such as irradiation time and irradiation intensity of each of the light-emitting components 2. The touch screen 36 generates a position signal that corresponds to a touched portion thereof and that is received by the control circuit 31, which generates the control signal accordingly. It should be noted that one of the counter 33 and the timer 34 as illustrated in FIGS. 5 and 6 may be included in the control unit 3 in other embodiments of this invention.

Figure 10:
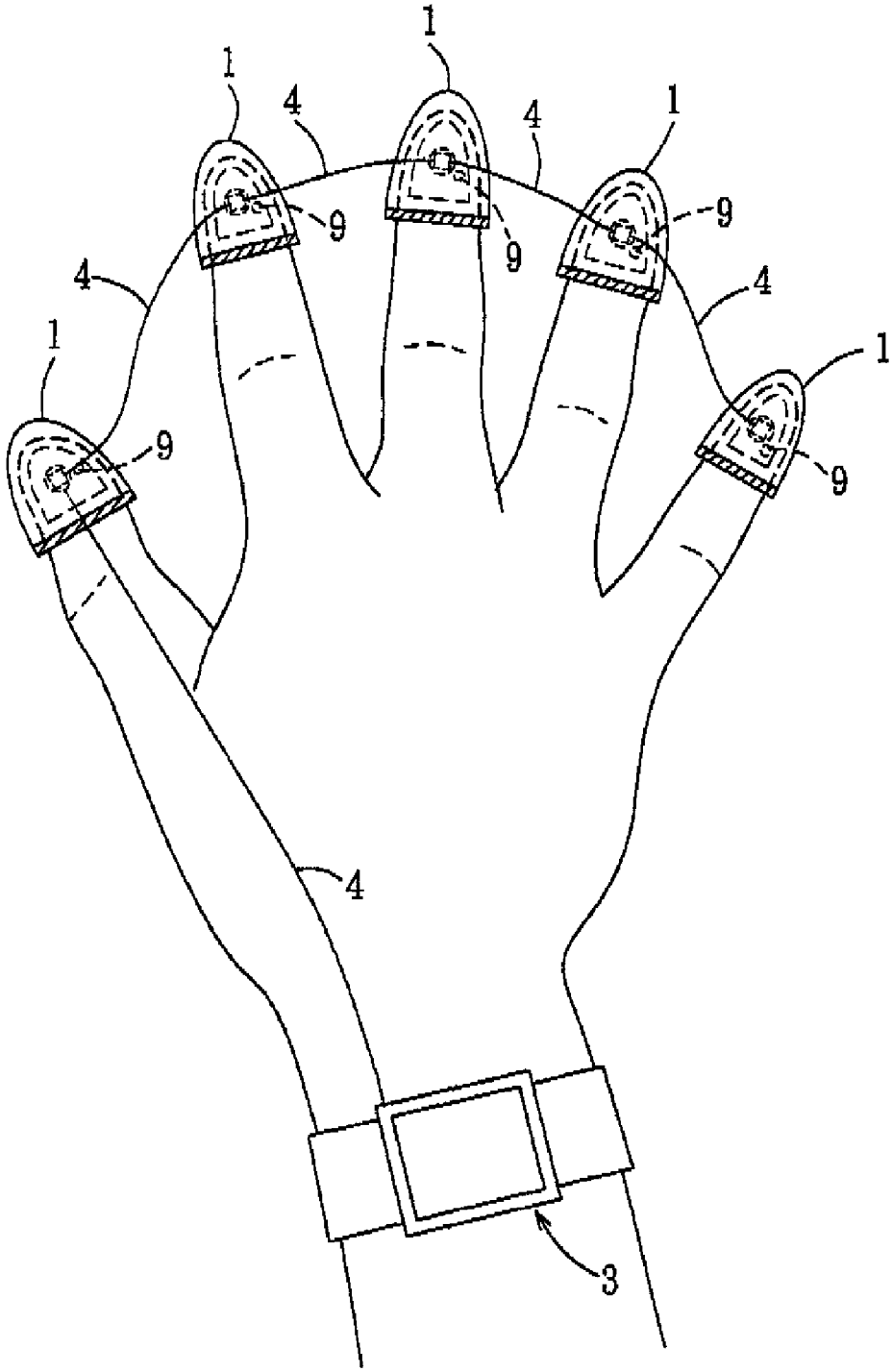
FIG. 10 is a schematic perspective view to illustrate a modified arrangement of transmission wires of the third preferred embodiment.

Furthermore, as shown in FIG. 10, a modified arrangement of the transmission wires 4 is shown. One of the transmission wires 4 may be coupled between the control circuit 31 of the control unit 3 and one of the light-emitting control modules 9, and each of the remaining transmission wires 4 is coupled between two adjacent ones of the light-emitting control modules 9 to thereby transmit the control signal from the control circuit 31 to the light-emitting control modules 9. The third preferred embodiment has the same advantages as those of the first preferred embodiment.

Figure 11:
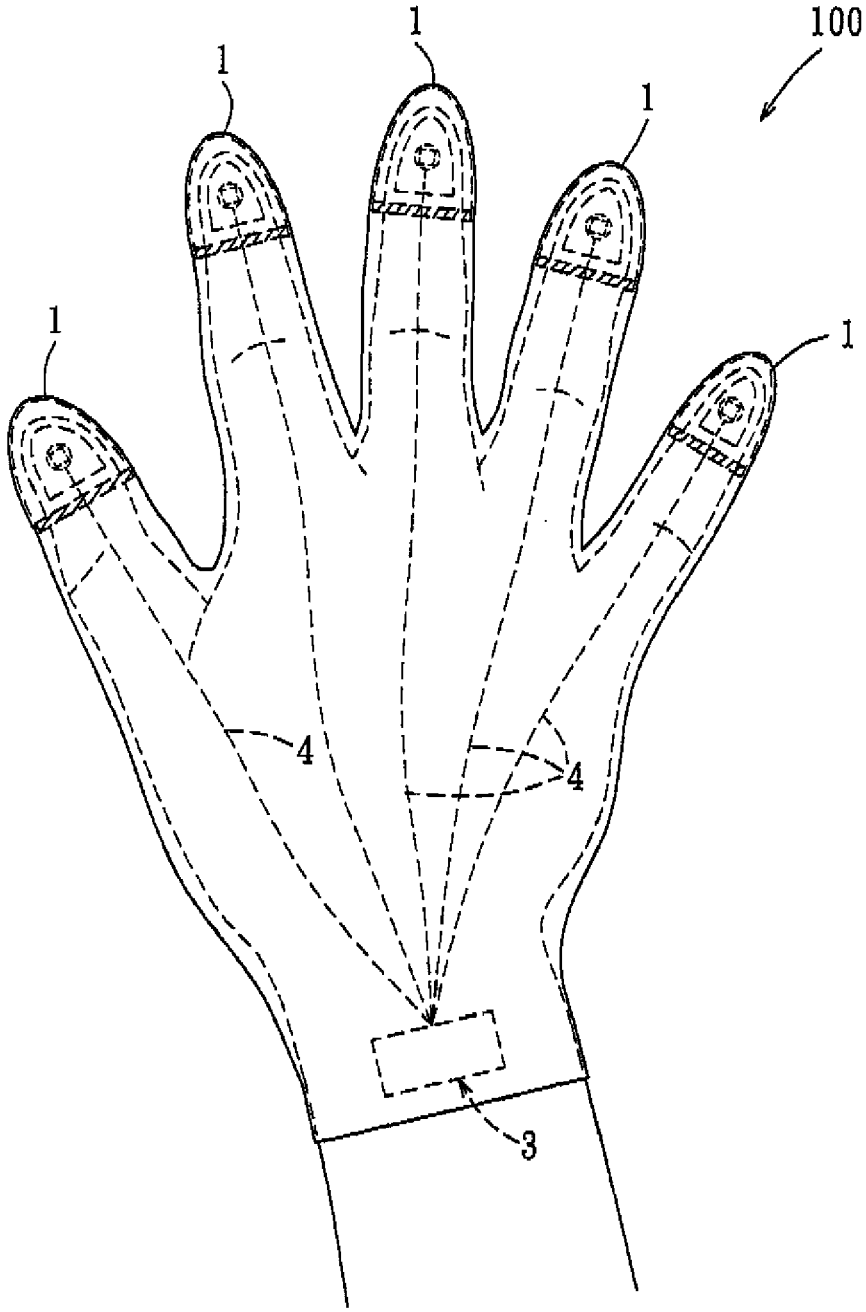
FIG. 11 is a schematic top view of a fourth preferred embodiment of the nail care device according to the present invention.

Referring to FIG. 11, a fourth preferred embodiment of the nail care device 100 according to the present invention has a structure similar to that of the third embodiment. The main difference between this embodiment and the third embodiment resides in the following. In this embodiment, the nail care device 100 further comprises a covering body configured for wearing on the limb and connected to the covering parts 1. The covering body is one of a hand covering, such as a glove, and a foot covering, such as a sock. The control unit 3 and the transmission wires 4 are covered by the covering body, thereby improving the visual aesthetic appeal of the nail care device of this invention. The fourth preferred embodiment has the same advantages as those of the third preferred embodiment.

Figure 12:
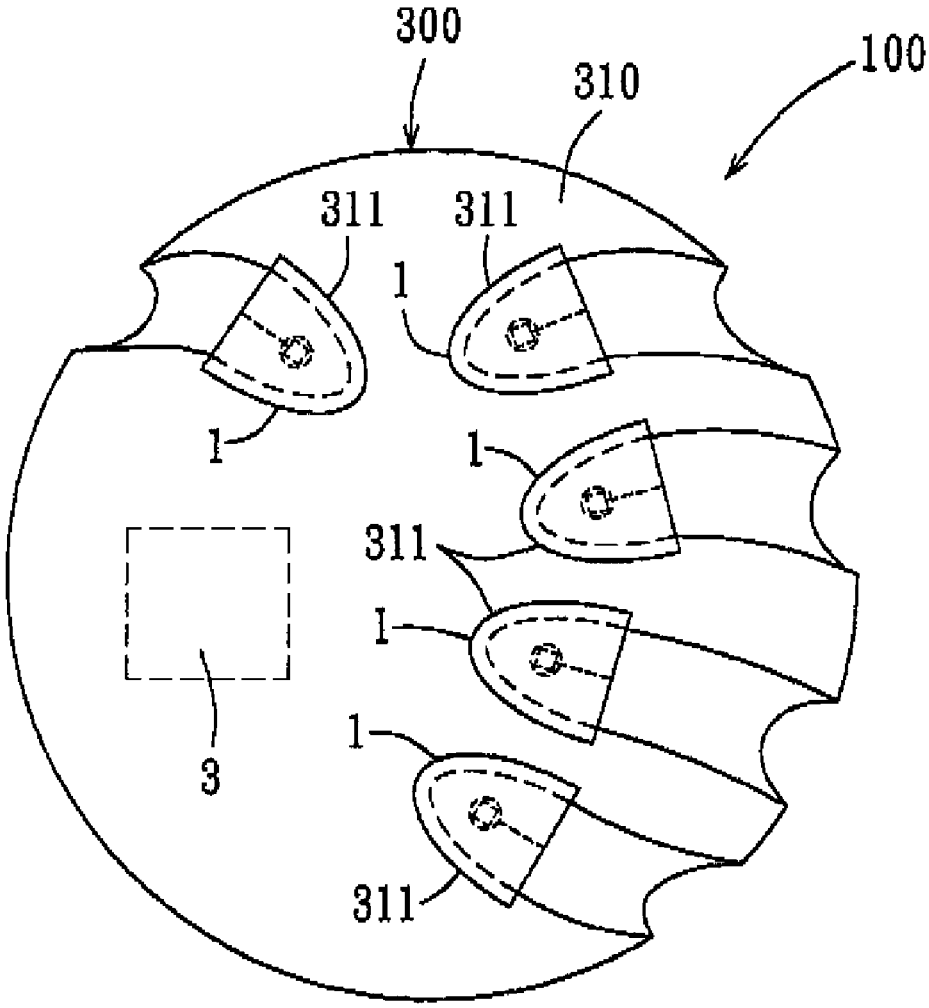
FIG. 12 is a schematic side view of a fifth preferred embodiment of the nail care device according to the present invention.

Referring to FIG. 12, a fifth preferred embodiment of the nail care device 100 according to the present invention has a structure similar to that of the third embodiment. The main difference between this embodiment and the third embodiment resides in the following. In this embodiment, the nail care device 100 further comprises a support configured as a ball-shaped body 300. The ball-shaped body 300 includes a housing 310 and is formed with five receiving spaces 311 for disposition of the covering parts 1 in a manner that permits insertion of tips of fingers of a hand into the covering parts 1 when the support is held by the hand of the user. The control unit 3 is disposed in the housing 310. The fifth preferred embodiment has the same advantages as those of the third preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A nail care device comprising:

a covering part configured for covering a tip of a digit of a limb;

a light-emitting component disposed in said covering part in a manner that light emitted by said light-emitting component irradiates a nail on the tip of the digit covered by said covering part;

a light-emitting control module coupled to said light-emitting component and operable to control operation of said light-emitting component; and a curved spacer being disposed in said covering part, the curved spacer having two side edges for abutting against opposite lateral sides of the tip of the digit covered by said covering part so as to space apart said light-emitting component from the nail on the tip of the digit covered by said covering part.

2. The nail care device as claimed in claim 1, wherein said covering part is adapted to be sleeved on the tip of the digit of the limb.

3. The nail care device as claimed in claim 2, wherein said covering part is made of a flexible material.

4. The nail care device as claimed in claim 3, wherein said covering part has a wall portion which is configured to be spaced apart from and to face the nail on the tip of the digit covered by said covering part, said light-emitting component being disposed on said wall portion.

5. The nail care device as claimed in claim 3, wherein said covering part defines an opening for insertion of the tip of the digit of the limb into said covering part, and is provided with a fixing unit for holding removably said covering part to the tip of the digit covered by said covering part.

6. The nail care device as claimed in claim 5, wherein said fixing unit includes an elastic band provided on said covering part adjacent to said opening for binding removably said covering part to the tip of the digit covered by said covering part.

7. The nail care device as claimed in claim 1, wherein said light-emitting control module is disposed on said covering part and is configured to control operation of said light-emitting component such that the light emitted by said light-emitting component falls within a specified frequency range of a full frequency spectrum of said light-emitting component.

8. The nail care device as claimed in claim 7, further comprising a control unit including a control circuit for generating a control signal to control operation of said light-emitting control module.

9. The nail care device as claimed in claim 8, wherein said control unit further includes a power supply unit for providing electric power to said control unit, said light-emitting control module and said light-emitting component.

10. The nail care device as claimed in claim 8, further comprising a wearable accessory on which said control unit is mounted.

11. The nail care device as claimed in claim 10, wherein said wearable accessory is one of a wrist accessory, a neck accessory and a leg accessory.

12. The nail care device as claimed in claim 8, further comprising a transmission wire coupled between said light-emitting control module and said control unit for transmitting the control signal from said control unit to said light-emitting control module.

13. The nail care device as claimed in claim 8, wherein said control unit further includes a controller for controlling duration of activation of said light-emitting component, said controller being one of a counter and a timer.

14. The nail care device as claimed in claim 1, further comprising an optical control unit disposed in said covering part and surrounding said light-emitting component for directing the light emitted by said light-emitting component toward the nail on the tip of the digit covered by said covering part.

15. The nail care device as claimed in claim 8, wherein said control unit further includes a power supply unit for providing electric power to said control unit, and a transmitting module for wireless transmission of the control signal, said nail care device further comprising a receiving module disposed on said covering part for wireless reception of the control signal transmitted by said control unit and coupled to said light-emitting control module for providing the control signal received thereby to said light-emitting control module, and a power supply provided on said covering part for providing electric power to said receiving module, said light-emitting control module, and said light-emitting component.

16. A nail care device comprising:

a plurality of covering parts, each adapted to be sleeved on a tip of a respective digit of a limb;

a plurality of light-emitting components, each disposed in a respective one of said covering parts in a manner that light emitted by said light-emitting component irradiates a nail on the tip of the digit covered by said covering part;

a plurality of light-emitting control modules, each coupled to and controlling operation of a respective one of said light-emitting components; and a plurality of curved spacers each disposed in a respective one of said covering parts, the curved spacers each having two side edges for abutting against opposite lateral sides of the tip of the digit covered by said covering part so as to space apart said light-emitting component from the nail on the tip of the digit covered by said covering part a support on which said covering parts are disposed.

17. The nail care device as claimed in claim 16, further comprising a control unit including a control circuit for controlling individual operations of said light-emitting control modules.

18. The nail care device as claimed in claim 16, further comprising a covering body configured for wearing on the limb and connected to said covering parts.

19. The nail care device as claimed in claim 18, wherein said covering body is one of a hand covering and a foot covering.

20. The nail care device as claimed in claim 16, wherein said support is a ball-shaped body, and said covering parts are disposed on said support in a manner that permits insertion of tips of fingers of a hand into said covering parts when said support is held by the hand.

* * * * *